US010704119B2

(12) United States Patent
Levanduski et al.

(10) Patent No.: US 10,704,119 B2
(45) Date of Patent: Jul. 7, 2020

(54) COKELESS SINTER BLEND COMPOSITIONS

(71) Applicant: NU-IRON TECHNOLOGY, LLC, Charlotte, NC (US)

(72) Inventors: Gary Levanduski, Convent, LA (US); Narayan Govindaswami, Charlotte, NC (US)

(73) Assignee: NU-IRON TECHNOLOGY, LLC., Charlotte, NC (US)

( * ) Notice: Subject to any disclaimer, the term of this patent is extended or adjusted under 35 U.S.C. 154(b) by 0 days.

(21) Appl. No.: 15/971,309

(22) Filed: May 4, 2018

(65) Prior Publication Data

US 2018/0320245 A1 Nov. 8, 2018

Related U.S. Application Data

(60) Provisional application No. 62/501,161, filed on May 4, 2017.

(51) Int. Cl.

| | |
|---|---|
| ***C22B 1/16*** | (2006.01) |
| ***C22C 33/00*** | (2006.01) |
| ***C22C 45/00*** | (2006.01) |
| ***C21B 3/02*** | (2006.01) |
| ***C21B 13/00*** | (2006.01) |

(52) U.S. Cl.

CPC ..... *C22B 1/16* (2013.01); *C21B 3/02* (2013.01); *C21B 13/0046* (2013.01); *C22C 33/003* (2013.01); *C22C 45/008* (2013.01)

(58) Field of Classification Search

CPC ..... C22B 1/16; C21B 3/02; C21B 13/0046; C22C 33/003; C22C 45/008

See application file for complete search history.

(56) References Cited

U.S. PATENT DOCUMENTS

| | | | | |
|---|---|---|---|---|
| 4,657,584 | A * | 4/1987 | Bogdan | C22B 1/16 75/768 |
| 5,127,939 | A | 7/1992 | Panigraphy et al. | |
| 5,395,441 | A * | 3/1995 | Bogdan | C21B 5/008 106/714 |
| 6,379,421 | B1 | 4/2002 | Salinas-Fernandez et al. | |
| 6,352,573 | B2 | 5/2002 | McClelland, Jr. et al. | |
| 9,045,809 | B2 | 2/2015 | Hendrickson et al. | |
| 9,238,253 | B2 | 1/2016 | Levanduski et al. | |
| 2009/0078088 | A1 | 3/2009 | Inazumi et al. | |

(Continued)

OTHER PUBLICATIONS

Pal, "Utilization of Microfines in Iron and Steel making," Steelworld, Jun. 2016, pp. 86-90 (Year: 2016).*

(Continued)

*Primary Examiner* — John A Hevey

(74) *Attorney, Agent, or Firm* — Hahn Loeser & Parks LLP

(57) ABSTRACT

Examples herein generally relate to sinter blend compositions for use in a sintering process that do not contain coke breeze (0.0% coke breeze), or contain only very small amounts of coke breeze. In particular, these sinter blend compositions are capable of repurposing mixture of iron-making reverts, having high total and metallic iron levels that re-oxidize so as to become a replacement fuel source for the coke breeze typically used in sinter blend compositions for use in a sintering process, while still managing to produce a sinter with sufficient ISO tumble strengths.

18 Claims, 2 Drawing Sheets

(56) References Cited

U.S. PATENT DOCUMENTS

2013/0192421 A1* 8/2013 Meynerts ..... C22B 1/24 75/306
2015/0167114 A1* 6/2015 Iwami ..... C22B 1/20 75/758

OTHER PUBLICATIONS

Nakano et al., "Coke Breeze-less Sintering of BOF Dust and Its Capability of Dezincing," ISIJ Int'l., vol. 40 (2000), No. 3, pp. 238-243 (Year: 2000).*
Nakano, et al., "Coke Breeze-less Sintering of BOF Dust and Its Capability of Dezincing" *ISIJ International*, vol. 40, No. 3, pp. 238-243 (2000).
Das, et al., "Effective Utilization of Blast Furnace Flue Dust of Integrated Steel Plants" *European Journal of Mineral Processing and Environmental Protection*, vol. 2, No. 2, 1303-0868, pp. 61-68 (2002).
Sikström, et al., "Recycling of Flue Dust Into the Blast Furnace" *TMS Conference in Lulea/Sweden*, Jun. 2002.
Anameric, et al., "Carburization effects on pig iron nugget making" *Minerals & Metallurgical Proceessing*, Vo. 23, No. 3, pp. 139-150, Aug. 2006.
Mishra, et al., "Development of Waste-Free Technology in the Steel Industry" *The Minerals, Metals & Materials Society*, pp. 1-8, 2008.
El-Hussiny, et al. "Effect of Recycling Blast Furnace Flue Dust as Pellets on the Sintering Performance" *Science of Sintering*, 42, pp. 269-281 (2010).
Sector Policies and Programs Division Office of Air Quality Planning and Standards U.S. Environmental Protection Agency, "*Available and Emerging Technologies for Reducing Greenhouse Gas Emissions From the Iron and Steel Industry*", EPA Office of Air and Radiation, Sep. 2012.
Singh, et al. "Effect of Sintering Performance of the Utilization of Blast Furnace Solid Wastes as Pellets" *Science Direct Procedia Materials Science* 5, pp. 2468-2477 (2014).
Ahmed, et al. "Energy Efficient Recycling of in-Plant Fines" *International Scholarly and Scientific Research & Innovation* 8, pp. 522-528 (2014).
Fu, et al. "CFD Investigation of the Effects of Iron Ore Reducibility and Coke Reactivity on Blast Furnace Operation" *Iron & Steel Technology*, pp. 57-64 Dec. 2014.
Imris, et al. "Ironarc: A Cokeless Ironmaking Process" *Iron & Steel Technology*, pp. 4450 Mar. 2015.
PAL "Utilization of Microfines in Iron and Steel Making" *Steelword* pp. 86-90, Jun. 2016.
Primary Metals "The Steel Making Industry" Chapter 2 Dec. 7, 2016.
Jul. 27, 2018 Transmittal of Int'l Search Report and Written Opinion of Int'l Searching Authority for PCT/US18/31070.

* cited by examiner

COKELESS SINTER BLEND COMPOSITIONS

This application claims priority to, and the benefit of, U.S. Provisional Application No. 62/501,161 filed on May 4, 2017 with the United States Patent Office, which is hereby incorporated by reference.

BACKGROUND

Production processes in the iron and steel industry involve the formation of large amounts of by-products that create waste streams governed by costly legal disposal requirements designed to prevent environmental pollution.

In an integrated iron and steel plant, one of the most important thermal operations is the sintering of raw iron ore. In a conventional sintering process, waste products from the iron making process (a mixture of iron bearing residues, such as blast furnace dust and filter cake, commonly referred to as "reverts"), are mixed with iron ores, coke breeze, and limestone to create a sinter blend composition. The sinter blend composition is then heated at high temperatures until it is sintered into a porous irregular shaped iron oxide—commonly known as a "sinter"—that is feedstock for a blast furnace used in the production of pig iron, and eventually the production of steel.

Conventional sinter blend compositions have some disadvantages. For example, the energy source for conventional sintering processes is the carbon contained in the sinter blend composition's coke breeze (dust and fines of coke). However, as a result of the rapid growth of the steel industry worldwide, coke breeze is becoming increasingly expensive and difficult to procure. Another issue with sinter blend compositions is that after the sintering process they generally must produce a sinter with an ISO 3271 tumble strength rating ("ISO tumble strength") typically, greater than 72, that is capable of withstanding the rigors of the blast furnace iron-making process, which involves movement of the sinter on conveyor belts, and into shaft furnaces, under significant weight compression. Accordingly, not all iron making reverts are easily repurposed by incorporation into a sinter blend composition, in evaluating a typical sinter blend it may be necessary to estimate the total energy content of the sinter blend composition. Depending on the blend, any of the following energy sources may be present: coke breeze, component metallics and component carbon. If the combined energy content of the sinter blend composition is too high, excessive temperatures and slagging may develop during the sintering process.

Direct reduced iron (DRI), sometimes called sponge iron, is a commercial product widely used as a source material for making steel. The conventional techniques for making steel involve the use of an electric arc furnace (EAF) or a basic oxygen furnace (BOF). DRI is typically higher in iron units than taconite pellets and other sources of iron, and can be used as a partial substitute for scrap in the production of steel by EAF.

DRI is formed from beneficiated iron ore, such as taconite pellets. For example, taconite has been mined and crushed, and the iron containing portions magnetically separated from the non-iron containing portions to form a beneficiated product higher in iron content than mined taconite. The beneficiated iron ore portion may be formed into pellets by pelletizing, and heated in a linear hearth furnace in the presence of reducing agent (e.g., carbonaceous material) to a temperature below the melting point of iron using natural gas or coal, to promote the reduction of iron ore to metallic iron. DRI is typically above 90% metallic iron with the remainder gangue.

In the process to make DRI, the beneficiated and pelletized iron oxide containing material is moved through a furnace mixed with a reducing agent, such as coal, coke, or another for of carbonaceous material. A desulfurizing agent, such as limestone or dolomite, is also typically added. The carbon of the reducing agent and the oxygen of the iron oxide material react chemically in the reducing zone of the furnace, thereby partially reducing the iron oxide to form metallic iron. This, and other traditional reducing processes, are used to create the DRI.

DRI is difficult to transport because DRI and DRI fines are highly reactive with oxygen in air and moisture. Moisture, in particular, reacts with the iron forming FeO and $H_2$. The DRI being sponge iron his many voids making it porous in nature. The porous nature of DRI also means that it has low compressive strength, and handling of DRI generates surface fines and dust. Additionally, when the DRI is stored, for example in the hold of a ship during transportation, some of the pellets have been prone to disintegrate under the weight of pellets above them further generating fines and small particles. The DRI lines and small particles increased the ability for reaction with moisture and oxygen around it. Additionally, the rough surface characteristics of the DRI pellets produce particulate matter and other fines having a high surface area, which also promoted the likelihood of the DRI reacting with oxygen. Such particulate matter and fines typically are produced throughout the storage and transportation of the DRI, making it difficult to transport DRI over long distances and to store DRI for long periods.

The porous, low internal strength, and flakey nature of DRI all increase the surface area of the nodule that is exposed to an oxidizing atmosphere and/or moisture, resulting in substantial and rapid oxidation and rusting. The reactions that occur during DRI oxidation produce heat and hydrogen making DRI susceptible to overheating and combustion. Increases in temperature in containers storing DRI, in which air is free to circulate, can reach 1200° F. Such combustion causes fires in the holds of ships during transportation of DRI and in the clam buckets of cranes when unloading DRI. These risks have substantially increased the cost of DRI delivered to a steel plant because of the losses during transportation and storage. Due to the difficulties and risks associated with transporting DRI, production of DRI has with a few exceptions been generally located near the steelmaking facilities and near the time of use in steelmaking, rather than in more economical locations and times. For these same reasons, the disposal of DRI fines and dusts is expensive and difficult.

While disposing of DRI reverts is expensive and environmentally challenging, it has now been determined that DRI fines and dust (DF blend) can be successfully repurposed by being incorporated and used as a replacement energy source to replace coke breeze in sinter blends. Accordingly, in cokeless sinter blends disclosed herein, the DRI reverts are used as a replacement fuel source for the coke breeze in the sintering process, while still producing sinter with an ISO tumble strength of at least 72. The cokeless sinter blends are inert, safe to transport, inexpensive to produce and provide sinter with the ISO tumble strength ratings necessary for use in conventional blast furnace iron-making processes.

As used herein, "cokeless" or "free of coke breeze" means no intentional addition of coke or coke breeze.

SUMMARY OF THE INVENTION

The invention described herein in multiple embodiments relates to sinter blend compositions for use in a sintering process that do not contain coke breeze (0.00% coke breeze), or contain only very small amounts of coke breeze. In particular, these sinter blend compositions are capable of repurposing a mixture of iron-making reverts, having high total and metallic iron levels that re-oxidize so as to become a replacement fuel source for the coke breeze typically used in sinter blend compositions for use in a sintering process, while still managing to produce a sinter with sufficient ISO tumble strengths.

In some embodiments, a sinter blend composition for use in a sintering process is a mixture of iron making reverts comprising a high metallic content blend, an oxide blend, a sludge blend, a dust blend, and a DF blend; wherein the sinter blend composition is free of coke breeze and is configured to produce a sinter with an ISO tumble strength of at least 72.

In some embodiments, a sinter blend composition for use in a sintering process is between 0.01% and 5.0% coke breeze and a mixture of iron making reverts, comprising a high metallic content blend, an oxide blend, a sludge blend, a dust blend, a DF blend; wherein the iron-making reverts contain, by weight, at least 10.0% metallic iron levels, and the sinter blend composition is configured to produce a sinter with an ISO tumble strength of at least 72.

Additional embodiments as well as the foregoing and other objects, features, and advantages of the examples will be apparent from the following more detailed descriptions of particular examples, as illustrated in the accompanying drawings wherein like reference numbers represent like parts of the examples.

DETAILED DESCRIPTION

Figure 1:
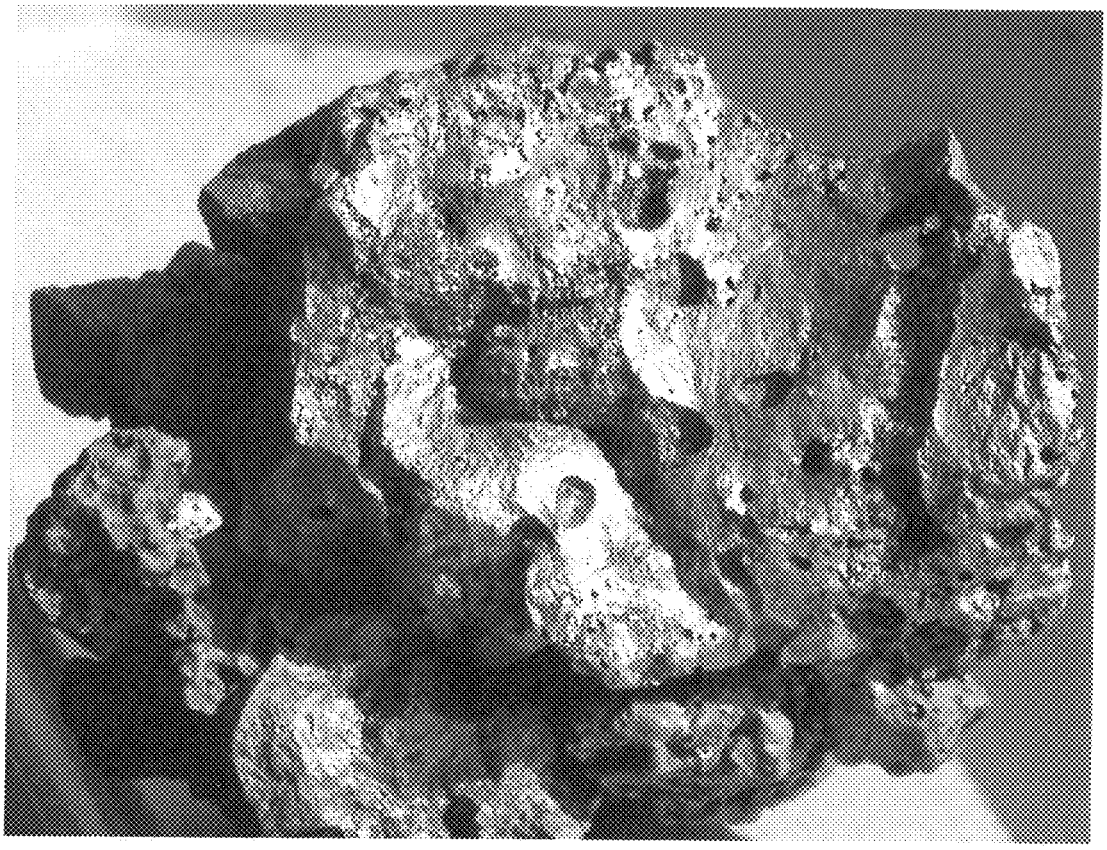
FIG. 1 is a photograph of an exemplary sinter formed from a sinter blend composition that is free of coke breeze.

In various embodiments, the inventive sinter blend compositions utilize a mixture of iron-making reverts such as DRI fines, dust and clarifier sludge, characterized by high metallic iron and total iron content levels in lieu of coke breeze, as the energy source in sinter blend compositions. In embodiments, the cokeless sinter blend composition may comprise a mixture of iron making reverts containing residues such as dust, fines and clarifier sludge resulting from the production of DRI and other additives that results—after the sintering process—in a sinter with an ISO tumble strength greater than 72.

TABLE 1

Component Chemistry
Component Chemical Analysis

| Description | $Fe_{tot}$ | $Fe^{++}$ | $SiO_2$ | $Al_2O_3$ | CaO | MgO | LOI | C | Fe met | % $H_2O$ |
|---|---|---|---|---|---|---|---|---|---|---|
| High Metallic Content Blend | 71.31 | 2.24 | 1.89 | 0.95 | 1.48 | 0.19 | −6.61 | 1.16 | 21.00 | 3.8 |
| Oxide Blend | 66.34 | 0.65 | 2.28 | 1.43 | 0.82 | 0.03 | 0.94 | | | 5.7 |
| Sludge Blend | 56.19 | 14.02 | 4.34 | 1.82 | 9.69 | 0.67 | 2.35 | 1.92 | 8.06 | 16.3 |
| Dust Blend | 79.28 | 1.72 | 4.05 | 2.11 | 7.39 | 0.64 | −27.22 | 4.59 | 76.49 | 0.3 |
| DF Blend | 80.55 | 1.69 | 2.99 | 1.29 | 5.94 | 0.50 | −26.86 | 6.41 | 78.07 | 0.5 |
| Quick Lime | 0.04 | | 1.13 | 0.34 | 92.12 | 4.77 | 2.90 | | | 0 |
| Limestone | 0.05 | | 0.82 | 0.17 | 53.58 | 0.90 | 43.67 | | | 5.5 |
| Olivine | 6.24 | 4.78 | 40.45 | 0.30 | 0.01 | 52.46 | 0.24 | | % Ash | 1.5 |
| Coke Breeze | 0.92 | | 6.14 | 2.86 | 0.49 | 0.19 | 88.2 | 87.5 | 11.84 | 21 |
| Silica Sand | 0.71 | | 98.22 | 0.19 | | | 0 | | | 0 |

BDL = Below Detection Limit
Negative LOI = Gain on Ignition

Table 1 identifies the chemical compositions of various mixtures of iron-making reverts, which were tested as sinter blend compositions. Such test sinter blend compositions comprised various mixtures of iron-making reverts that included one or more of a high metallic content blend, oxide blend, sludge blend, dust blend, and DRI fines (hereafter, "DF blend"). Optionally, the sinter blend compositions also comprised additives such as limestone, silica sand, quick lime, and olivine. See Tables 1-4.

TABLE 2

Component Size Distribution
Component Size Analysis, % wt On Size

| | mesh | | | | | | | | | |
|---|---|---|---|---|---|---|---|---|---|---|
| | ½" | ⅜" | 3 | 4 | 6 | 8 | 10 | 14 | 20 | 28 |
| | mm | | | | | | | | | |
| Description | 12.7 | 9.525 | 6.8 | 4.7 | 3.3 | 2.36 | 1.65 | 1.168 | 0.833 | 0.589 |
| High Metallic Content Blend | | | 15.2 | 16.1 | 10 | 6.4 | 2.9 | 6.4 | 2.9 | 2.9 |
| Oxide Blend | | 0.0 | 8.8 | 10.5 | 2 | 0.7 | 0.5 | 1.5 | 1.4 | 2.0 |
| Sludge Blend | | 0.0 | 0.0 | 0.2 | 0 | 0.0 | 0.0 | 0.0 | 0.2 | 1.2 |
| Dust Blend | | 0.0 | 0.0 | 0.0 | 0 | 0.0 | 0.0 | 0.0 | 0.0 | 0.0 |

TABLE 2-continued

| Component Size Distribution<br>Component Size Analysis, % wt On Size | | | | | | | | | |
|---|---|---|---|---|---|---|---|---|---|
| DF Blend | | 0.0 | 0.0 | 0.0 | 0 | 0.0 | 0.0 | 0.0 | 0.0 | 0.0 |
| Quick Lime | | | 0.00 | 0.00 | 0.0 | 0.00 | 0.00 | 0.00 | 0.00 | 0.00 |
| Limestone | | | 0.29 | 2.02 | 5.6 | 15.70 | 8.24 | 23.78 | 10.26 | 7.79 |
| Olivine | | | 0.00 | 0.00 | 0.0 | 0.00 | 0.00 | 0.00 | 5.17 | 25.16 |
| Coke Breeze | | 0.00 | 1.30 | 6.45 | 10.4 | 10.42 | 4.33 | 12.19 | 6.49 | 7.55 |
| Silica Sand | | | | | | | | | | 0.00 |

| | mesh | | | | | | | | |
|---|---|---|---|---|---|---|---|---|---|
| | 35 | 48 | 65 | 100 | 150 | 200 | 270 | 325 | −325 |
| | mm | | | | | | | | |
| Description | 0.417 | 0.295 | 0.208 | 0.147 | 0.104 | 0.074 | 0.053 | 0.044 | |
| High Metallic Content Blend | 2.1 | 1.7 | 1.5 | 1.4 | 1.6 | 2.0 | 2.5 | 1.3 | 22.7 |
| Oxide Blend | 1.8 | 1.8 | 1.8 | 1.8 | 1.8 | 2.2 | 3.7 | 2.8 | 54.9 |
| Sludge Blend | 1.8 | 2.2 | 2.4 | 3.3 | 4.3 | 6.5 | 9.1 | 5.1 | 63.9 |
| Dust Blend | 0.0 | 0.0 | 0.0 | 0.0 | 0.1 | 0.3 | 1.1 | 1.1 | 97.4 |
| DF Blend | 0.0 | 0.0 | 0.0 | 0.0 | 0.1 | 0.2 | 1.2 | 1.5 | 97.0 |
| Quick Lime | 0.00 | 0.00 | 0.00 | 1.95 | 1.85 | 4.25 | 2.60 | 0.25 | 89.0 |
| Limestone | 5.11 | 3.71 | 2.68 | 1.77 | 1.07 | 0.78 | 0.58 | 0.21 | 10.3 |
| Olivine | 39.32 | 21.47 | 3.00 | 0.52 | 1.05 | 1.77 | 1.28 | 0.27 | 0.99 |
| Coke Breeze | 7.51 | 7.31 | 6.53 | 5.15 | 3.69 | 2.79 | 1.97 | 0.67 | 5.42 |
| Silica Sand | 3.57 | 25.21 | 31.69 | 30.84 | 8.19 | 0.50 | 0.00 | 0.00 | 0.00 |

The component size distribution for the various blends is summarized in Table 2. The mixing and granulation processes employed in the production of the sinter blend compositions disclosed herein are conventional, and may include one or more of the addition of water to produce slurries, screening of blends to remove oversize pellets, and/or use of medium or high intensity mixing devices.

Disclosed herein is a cokeless sinter blend composition for use in a sintering process, which comprises a mixture of DRI making reverts. The DRI reverts may comprise one or more of a high metallic content blend, an oxide blend, a sludge blend, a dust blend, and a DF blend. In embodiments, the sinter blend composition may comprise only a mixture of iron-making reverts, be free of coke breeze, and be capable of producing a sinter with an ISO tumble strength of at least 72. In some embodiments, the quality of sinter produced from a coke free sinter blend composition may be characterized by having an ISO tumble strength of at least +6.35 mm: >75%; a reducibility of ISO 4695, R40: >1% and an [low temperature reduction-disintegration indices] ISO 4696, +6.36 mm: >66%. Unless otherwise indicated all compositions are given in weight percent.

In embodiments, the sinter blend composition may comprise between 38.0% and 44.0% high metallic content blend, between 27.0% and 34.0% oxide blend, between 4.0% and 8.0% sludge blend, between 0.5% and 4.5% dust blend and between 17.0% and 23.0% DF blend. The sinter blend composition may comprise, by weight, approximately 41.3% high metallic content blend, approximately 30.6% oxide blend, approximately 5.9% sludge blend, approximately 2.2% dust blend and approximately 20.0% DF blend.

In one embodiment, the sinter blend composition may comprise the composition, and corresponding characteristics, shown in Table 3. In embodiments, the cokeless sinter blend composition comprises, by weight, at least about 20.0% metallic iron. In embodiments, the cokeless sinter blend composition comprises 21.69% metallic iron, and 0.0% coke breeze, with a corresponding estimated mix chemical energy of 1.92 GJ/t. See Table 3 in case of a shortfall in the availability of DF Blend, the balance mix chemical energy may be met with the addition of low levels of coke breeze, as discussed infra. In embodiments, the cokeless sinter blend composition may additionally comprise one or more additives, including one or more of limestone, quick lime, olivine and silica sand.

TABLE 3

| Sinter Test Summary | | | |
|---|---|---|---|
| | Triplicated | | |
| Test # | 1 | 2 | 3 |
| Comments | S. Fines | S. Fines | S. Fines |
| Comments | 2% Lime | 2% Lime | 2% Lime |
| Target Moisture % Wt | 8.70 | 8.70 | 8.70 |
| Measured, Mix % wt Moist | 7.70 | 7.60 | 7.60 |
| Blend, % wt Dry Basis | | | |
| High Metallic Content Blend | 33.87 | 33.87 | 33.87 |
| Oxide Blend | 25.09 | 25.09 | 25.09 |
| Sludge Blend | 4.84 | 4.84 | 4.84 |
| Dust Blend | 1.80 | 1.80 | 1.80 |
| DF Blend | 16.40 | 16.40 | 16.40 |
| Silica Sand | 1.31 | 1.31 | 1.31 |
| Limestone | 12.15 | 12.15 | 12.15 |
| Quick Lime | 1.98 | 1.98 | 1.98 |
| Olivine | 2.56 | 2.56 | 2.56 |
| Coke Breeze | 0.00 | 0.00 | 0.00 |
| Raw Mix Totals | 100.0 | 100.0 | 100.0 |
| Total Flux Addition, % Dry Basis | 18.0 | 18.0 | 18.0 |
| Raw Mix, % wt | 70.0 | 70.0 | 70.0 |
| Est. % Metallics in Sinter Mix, % wt | 21.69 | 21.69 | 21.69 |
| Return Fines in Mix, % wt | 30.0 | 30.0 | 30.0 |
| Est. Mix Chemical Energy, GJ/t | 1.92 | 1.92 | 1.92 |
| Target $CaO/SiO_2$ | 2.40 | 2.40 | 2.40 |
| Target % $SiO_2$ | 4.37 | 4.37 | 4.37 |
| Target % MgO | 1.72 | 1.72 | 1.72 |
| Press., mbar | 162 | 162 | 162 |
| Max Ignition Temp., °C. | 1309 | 1283 | 1274 |
| Max Ave. Wind Box Temp, min | 21.08 | 23.00 | 20.75 |
| Max Ave. Wind Box Temp., °C. | 501 | 472 | 446 |
| Max H, Layer Temp., min | 17.25 | 26.00 | 23.00 |
| Hearth Layer Temp., °C. | 1146 | 1204 | 1314 |
| Pot Bulk Density (wet), $kg/m^3$ | 2040.7 | 2169.1 | 2088.5 |

TABLE 3-continued

| Sinter Test Summary | | | |
|---|---|---|---|
| Wet Mix Depth, in (18" = 450 mm) | 18.0 | 18.0 | 18.0 |
| Bed Shrinkage, % Starting Depth | 0.0 | 0.0 | 10.3 |
| Productivity | | | |
| Ave Wbox Temp, Mt/m$^2$-24 hr | 40.74 | 39.62 | 42.27 |
| Hearth Layer Temp, Mt/m$^2$-24 hr | 49.78 | 35.05 | 38.13 |
| Wt Recovery | 99.57 | 99.31 | 99.26 |
| Averaged Returns Ratio (Out/In) | 0.97 | 1.04 | 0.87 |
| Averaged Returns Ratio (In/Out) | 1.03 | 0.97 | 1.15 |
| % Returns in Mix (Dry Basis) | 30.00 | 30.00 | 30.00 |
| ISO-3271 Tumble % wt. +6.3 mm | 79.2 | 80.8 | 83.9 |
| Product (−5 mm × +6.3 mm) | | | |
| $Fe_{Tot}$ | 57.94 | 58.48 | 58.34 |
| FeO | 9.52 | 9.51 | 9.75 |
| $Fe_{met}$ | 1.79 | 1.62 | 1.61 |
| $SiO_2$ | 4.60 | 4.56 | 4.47 |
| $Al_2O_3$ | 0.99 | 1.00 | 0.95 |
| CaO | 10.61 | 10.67 | 10.71 |
| MgO | 1.74 | 1.73 | 1.71 |
| C | 0.04 | 0.03 | 0.02 |
| B2 = $CaO/SiO_2$ | 2.31 | 2.34 | 2.40 |
| B4 = (CaO + MgO)/(SiO2 + Al2O3) | 2.21 | 2.24 | 2.31 |
| Return Fines −6.3 mm | 57.16 | 57.46 | 57.37 |
| FeO | 8.48 | 10.47 | 9.88 |
| $Fe_{met}$ | 1.39 | 2.68 | 2.31 |
| $SiO_2$ | 4.87 | 4.80 | 4.81 |
| $Al_2O_3$ | 1.13 | 1.06 | 1.00 |
| CaO | 11.27 | 11.14 | 11.38 |
| MgO | 1.97 | 1.99 | 2.05 |
| C | 0.08 | 0.18 | 0.07 |
| $CaO/SiO_2$ | 2.31 | 2.32 | 2.37 |
| Product Conditioning Size Distribution | | | |
| −50.8 + 38.1 mm | 2.7 | 3.0 | 3.6 |
| −38.1 + 25.4 mm | 9.9 | 13.1 | 12.3 |
| −25.4 + 19.1 mm | 15.5 | 14.6 | 17.5 |
| −19.1 + 15.9 mm | 8.3 | 6.9 | 7.1 |
| −15.9 + 12.7 mm | 8.1 | 6.2 | 7.2 |
| −12.7 + 9.5 mm | 17.1 | 15.4 | 15.4 |
| −9.5 + 6.3 mm | 13.6 | 13.5 | 13.3 |
| −6.3 mm | 24.8 | 27.2 | 23.6 |
| Totals | 100.00 | 100.00 | 100.00 |
| Metallurgical Tests | | | |
| ISO-4695 Reducibility, $R_{40}$ %/min | 1.05 | 1.08 | 1.14 |
| ISO-4696-1 LTD % wt. +6.3 mm | 68.0 | 70.0 | 61.6 |
| % wt. −6.3 + 3.15 | 19.6 | 19.8 | 24.3 |
| % wt. −3.15 + 32M (0.5 mm) | 10.2 | 8.1 | 11.6 |
| % wt −32M (0.5 mm) | 2.2 | 2.1 | 2.5 |

In some embodiments, the sinter blend composition may be free (0.0%) of coke breeze (or other carbonaceous materials, including biomass) and comprise, by weight, between 33.0% and 40.0% high metallic content blend, between 25.0% and 30.0% oxide blend, between 0.0% and 5.0% sludge blend, between 0.0% and 2.2% dust blend, and between 14.0% and 18.0% DF blend, with the remainder comprising impurities and/or one or more fluxes in an amount necessary to meet target basicity, silica and MgO levels in sinter. In various embodiments, the fluxes may comprise one or more of limestone, dolo-stone, quick lime, hydrated lime, milk of lime, other calcareous materials, magnesite, olivine, serpentine, silica sand, or other such components known to persons of skill in the art. In one embodiment, the sinter blend composition may comprise between 10.00% and 14.00% limestone, between 0.50% and 4.00% quick lime, between 0.50% and 5.00% olivine and between 0.50% and 3.50% silica sand. In embodiments, the total iron metallics in the sinter blend may be less than or equal to 22.0%. In embodiments, the sinter blend compositions may be free of coke breeze and comprise, by weight, approximately 33.87% high metallic content blend, approximately 25.09% oxide blend, approximately 4.84% sludge blend, approximately 1.80% dust blend, approximately 16.40% DF blend, approximately 12.15% limestone, approximately 1.98% quick lime, approximately 2.56% olivine and approximately 1.31% silica sand, which resulted in sinter having an ISO tumble strength of between 79.2 and 83.9. See Table 3.

In embodiments, the chemical composition of the high metallic content blend of the sinter blend composition may comprise, at least, iron (Fe), silicon dioxide ($SiO_2$), aluminum oxide ($Al_2O_3$), calcium oxide (CaO), magnesium oxide (MgO) and carbon (C). In embodiments, the high metallic content blend may comprise, by weight, between 68.0% and 74.0% total iron ($Fe_{TOT}$) levels, between 1.0% and 3% $SiO_2$, between 0.05% and 2.0% $Al_2O_3$, between 0.50% and 2.50% CaO, between 0.05% and 1.50% MgO, and between 0.20% and 2.20% C, with the remainder being impurities. The high metallic content blend may also comprise, by weight, approximately 71.31% total iron ($Fe_{TOT}$) levels, approximately 1.89% $SiO_2$, approximately 0.95% $Al_2O_3$, approximately 1.48% CaO, approximately 0.19% MgO, approximately 1.16% C, with the remainder being impurities.

In embodiments, the chemical composition of the oxide blend of the sinter blend composition may comprise, at least, iron (Fe), silicon dioxide ($SiO_2$), aluminum oxide ($Al_2O_3$), calcium oxide (CaO), and magnesium oxide (MgO). In embodiments, the oxide blend may comprise, by weight, between 63.00% and 68.50% $Fe_{TOT}$, between 1.00% and 3.50% $SiO_2$, between 0.50% and 2.50% $Al_2O_3$, between 0.05% and 2.00% CaO, and between 0.01% and 1.50% MgO, with the remainder being impurities. In embodiments, the oxide blend may comprise, by weight, approximately 66.34% $Fe_{TOT}$, approximately 2.28% $SiO_2$, approximately 1.43% $Al_2O_3$, approximately 0.82% CaO, and approximately 0.03% MgO, with the remainder being impurities.

In embodiments, the chemical composition of the sludge blend of the sinter blend composition may comprise, at least, iron (Fe), silicon dioxide ($SiO_2$), aluminum oxide ($Al_2O_3$), calcium oxide (CaO), magnesium oxide (MgO) and carbon (C). In embodiments, the sludge blend may comprise, by weight, between 53.00% and 59.00% total iron ($Fe_{TOT}$) levels, between 3.00% and 6.00% $SiO_2$, between 0.50% and 3.00% $Al_2O_3$, between 8.00% and 12.00% CaO, between 0.05% and 2.00% MgO, and between 0.50% and 3.00% C, with the remainder being impurities. The sludge blend may also comprise, by weight, approximately 56.19% total iron ($Fe_{TOT}$) levels, approximately 4.34% $SiO_2$, approximately 1.82% $Al_2O_3$, approximately 9.69% CaO, approximately 0.67% MgO, and approximately 1.92% C, with the remainder being impurities. In embodiments, the sludge blend may comprise between 10.0% and 20.0% water, or approximately 16.3% water.

In embodiments, the chemical composition of the dust blend of the sinter blend composition may comprise, at least, iron (Fe), silicon dioxide ($SiO_2$), aluminum oxide ($Al_2O_3$), calcium oxide (CaO), magnesium oxide (MgO) and carbon (C). In embodiments, the dust blend may comprise, by weight, 76.00% and 82.00% total iron ($Fe_{TOT}$) levels, between 2.00% and 6.00% $SiO_2$, between 1.00% and 3.50% $Al_2O_3$, between 5.00% and 9.500% CaO, between 0.05% and 1.50% MgO, and between 3.00% and 6.00% C, and the remainder impurities. The dust blend may also comprise, by weight, approximately 79.28% total iron ($Fe_{TOT}$) levels, approximately 4.05% $SiO_2$, approximately 2.11% $Al_2O_3$, approximately 7.39% CaO, approximately 0.64% MgO, and approximately 4.59% C, with the remainder being impurities. In embodiments, the dust blend may comprise between 0.01% and 1.0% water, or approximately 0.3% water.

In embodiments, the chemical composition of the DF blend of the sinter blend composition may comprise, at least, iron (Fe), silicon dioxide ($SiO_2$), aluminum oxide ($Al_2O_3$), calcium oxide (CaO), magnesium oxide (MgO) and carbon (C). In embodiments, the DF blend may comprise, by weight, between 77.00% and 84.00% total iron ($Fe_{TOT}$) levels, between 1.00% and 5.00% $SiO_2$, between 0.05% and 3.00% $Al_2O_3$, between 4.00% and 8.00% CaO, between 0.05% and 1.50% MgO, and between 4.00% and 8.50% C, with the remainder being impurities. The DF blend may also comprise, by weight, approximately 80.55% total iron ($Fe_{TOT}$) levels, approximately 2.99% $SiO_2$, approximately 1.29% $Al_2O_3$, approximately 5.94% CaO, approximately 0.50% MgO, and approximately 6.41% C, with the remainder being impurities.

Figure 2:
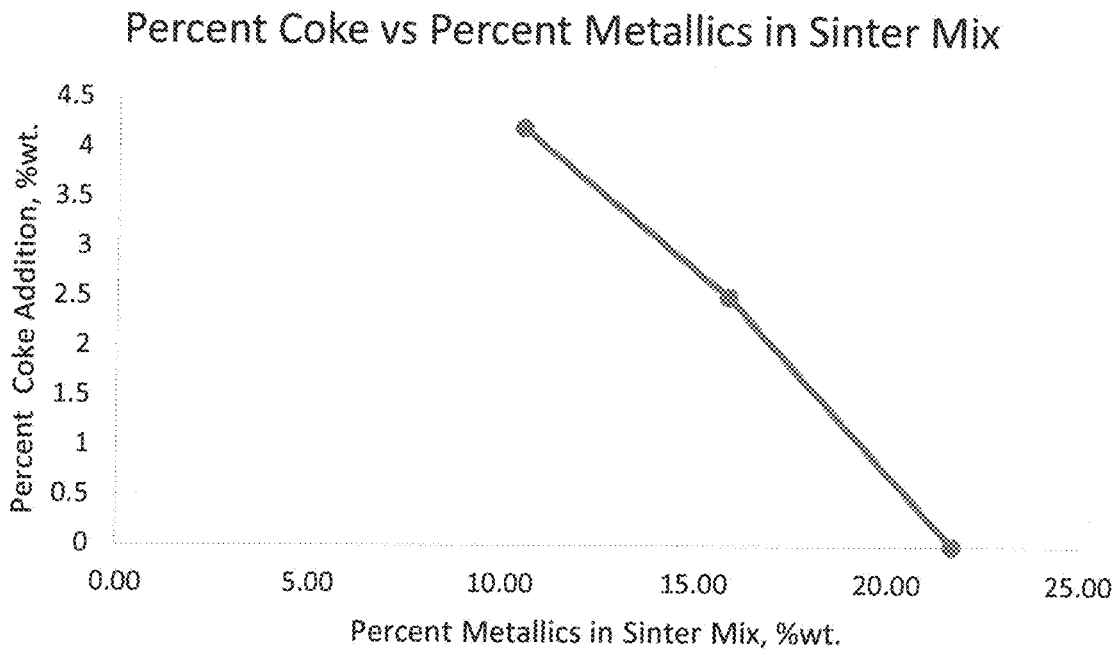
FIG. 2 is a chart showing the relationship between the percentages of coke breeze and metallics content in sinter blend compositions.

In still other embodiments, the sinter blend composition may comprise a mixture of iron-making reverts (including, at least, a DF blend) and coke breeze or other carbonaceous materials, including bio-mass. The relative relationship between the amount of metallics content to coke content is shown in FIG. 2. In embodiments combining iron making reverts and coke breeze, the levels of coke breeze may be significantly reduced so as to save on the cost of producing the sinter blend composition, and include only those amounts as may be necessary to meet the mix chemical energy requirements. In these embodiments, the iron-making reverts may contain, by weight, between 10.0% and 20.0% metallic iron levels, or at least 20.0% metallic iron levels. In certain embodiments, the sinter blend composition may comprise, by weight, between 0.01 and less than about 5.0% coke breeze. In various embodiments, shown generally in FIG. 2, the sinter blend composition may comprise approximately 4% coke breeze, 2% coke breeze, or less than about 0.5% coke breeze. In these embodiments, the sinter blend composition combining iron making reverts and coke breeze may be configured to produce sinter with an ISO tumble strength of at least 72. In one embodiment, the sinter blend composition may comprise, by weight, less than 4.5% coke breeze, with a metallic iron level of at least 10%. In one embodiment, the sinter blend composition may comprise, by weight, approximately 3.0% coke breeze, with an increased metallic iron level of approximately 15.0%, or less than 3.0% coke breeze, with a metallic iron level of at least 15.0%. In embodiments where the sinter blend composition contains only small amounts of coke breeze, the high total and metallic iron levels act as the principal fuel source for the sintering process, while still producing sinter with an acceptable ISO tumble strength.

In embodiments, the high metallic content blend, an oxide blend, a sludge blend, a dust blend, DF blend and additives may additionally comprise varying levels of water ($H_2O$).

TABLE 4

| | % Wt. Components | Cokeless Sinter Blend |
|---|---|---|
| DRI Reverts | High Metallic Content Blend | 33.87 |
| | Oxide Blend | 25.09 |
| | Sludge Blend | 4.84 |
| | Dust Blend | 1.8 |
| | DF Blend | 16.4 |
| | % Metallic Blend (calc) | 21.00 |
| Additives | Coke Breeze | 0.00 |
| | Limestone | 12.15 |

TABLE 4-continued

| % Wt. Components | Cokeless Sinter Blend |
|---|---|
| Quick Lime | 1.98 |
| Olivine | 2.56 |
| Silica Sand | 1.31 |

Return Fines at 30% of Wet Mix

Table 4 shows an exemplary cokeless sinter blend with return fines of 30% of wet mix that is fired to produce sinter. This composition comprises DRI reverts comprising, by weight, 33.87% high metallic content blend, 25.09% oxide blend, 4.84% sludge blend, 1.8% dust blend, 16.4% DF blend, and a calculated metallic blend percentage of 21.00%. The composition further comprises additives in the amount of 0.00% coke breeze, 12.15% limestone, 1.98% quick lime, 2.56% olivine and 1.31% silica sand.

TABLE 5

| | Sinter Produced |
|---|---|
| Mix Moisture, % wt. | 7.6 |
| Coke Add'n, % wt. | 0 |
| Dry Mix Metallics, % wt. | 21.69 |
| Dry Mix Tot. Flux, % wt. | 18.00 |
| $SiO_2$, % wt. | 4.54 |
| CaO, % wt. | 10.66 |
| MgO, % wt. | 1.73 |
| B2 ($CaO/SiO_2$) | 2.35 |
| Residual Metallics in Product, % wt. | 1.67 |
| Return Fines, % wt. | 30.00 |
| Ave. Returns Ratio (Fines Out/Fines In) | 0.96 |
| ISO Tumble, +6.3 mm, % wt. | 81.30 |
| Ave Prod. (Wind Box), $Mt/m^2$-24 hr | 40.87 |
| ISO-4695 $R_{40}$ %/min | 1.09 |
| ISO 4696 +6.3 mm, % wt. | 66.53 |
| ISO-4696 −0.5 mm, % wt. | 2.27 |

Table 5 is an analysis of an exemplary cokeless sinter produced in accordance with the present invention, comprising, by weight, a total dry mix of metallics of 21.69%; a total dry mix flux of 18.00% with a mix moisture of 7.6%, a return fines weight percentage of 30% and an ISO tumble strength of 81.30. FIG. 1 is a photograph of an exemplary sinter formed from a sinter blend composition that is free of coke breeze.

In one embodiment, the sinter blend composition for use in a sintering process may comprise, by weight: 33.87% high metallic content blend, 25.09% oxide blend, 4.84% sludge blend, 1.8% dust blend, 16.4% DF blend, plus additives in the amount of 0.00% coke breeze, 12.15% limestone, 1.98% quick lime, 2.56% olivine and 1.31% silica sand; wherein the calculated metallics percentage is 21.69%, with a corresponding estimated mix chemical energy of 1.92 GJ/t, an ISO tumble strength of at least +6.35 mm 75%, a reducibility of ISO 4695, R40: >1%, and a low temperature reduction-disintegration indices ISO 4696, +6.36 mm: >66%.

In utilizing the sinter blend compositions disclosed herein, it can be appreciated that DRI reverts—that are effectively difficult and expensive to dispose of waste by-products—can be repurposed in a meaningful way to produce sinters with good quality mechanical properties (such as strong ISO tumble strength ratings), excellent transportation capabilities (because the DRI fines and dust have been rendered inert), and economical (because the expensive coke breeze has been replaced with waste materials).

While it has been described with reference to certain embodiments, it will be understood by those skilled in the art that various changes may be made, and that combinations and equivalents of the above-described sinter blend composition component features may be combinable with other features, and may otherwise be substituted, re-arranged, and claimed in different ways without departing from scope. In addition, many modifications may be made to adapt a particular situation or material to the teachings without departing from its scope. Therefore, it is intended that it not be limited to the particular embodiments disclosed, but that it will include all embodiments falling within the scope of the detailed description and appended claims.

What is claimed is:

1. A sinter blend composition for use in a sintering process, comprising:

a mixture of iron making reverts and a DF blend that is a blend of DRI fines having a component size distribution less than 6.8 mm where the DF blend comprises, by weight, between 77.00% and 84.00% total iron ($Fe_{TOT}$), between 1.00% and 5.00% $SiO_2$, between 0.05% and 3.00% $Al_2O_3$, between 4.00% and 8.00% CaO, between 0.05% and 1.50% MgO, between 4.00% and 8.50% C, and the remainder being impurities; and wherein the sinter blend composition is free of coke breeze and is configured to produce a sinter with an ISO tumble strength of at least 72.

2. The sinter blend composition of claim 1 wherein the mixture of iron making reverts comprise:

a high metallic content blend comprising, by weight, between 68.0% and 74.0% total iron ($Fe_{TOT}$) and having a majority of a component size distribution captured by sieve mesh sizes between 6.8 mm and 0.044 mm;

an oxide blend comprising, by weight, between 63% and 68.5% total iron ($Fe_{TOT}$) and having a majority of the component size distribution of less than 6.8 mm;

a sludge blend comprising, by weight, between 53.00% and 59.00% total iron ($Fe_{TOT}$) and having a majority of the component size distribution passing a sieve mesh size of less than 0.033 mm; and a dust blend comprising, by weight, between 76.00% and 82.00% total iron ($Fe_{TOT}$) and having a majority of the component size distribution passing a sieve mesh size of less than 0.044 mm.

3. The sinter blend composition of claim 1, wherein the sinter blend composition comprises, by weight, at least 20.0% metallic iron.

4. The sinter blend composition of claim 3, wherein the sinter blend composition comprises, by weight, 21.69% metallic iron, with a corresponding estimated mix chemical energy of 1.92 GJ/t.

5. The sinter blend composition of claim 2, wherein the sinter blend composition comprises, by weight, between 38.0% and 44.0% high metallic content blend, between 27.0% and 34.0% oxide blend, between 4.0% and 8.0% sludge blend, between 0.5% and 4.5% dust blend and between 17.0% and 23.0% DF blend.

6. The sinter blend composition of claim 5, wherein the sinter blend composition comprises, by weight, approximately 41.3% high metallic content blend, approximately 30.6% oxide blend, approximately 5.9% sludge blend, approximately 2.2% dust blend and approximately 20.0% DF blend.

7. The sinter blend composition of claim 1, wherein the sinter produced from a cokeless sinter blend composition is characterized by:

an ISO tumble strength of at least +6.35 mm: >75%;

a reducibility of ISO 4695, R40: >1%; and a low temperature reduction-disintegration indices ISO 4696, +6.36 mm: >66%.

8. The sinter blend composition of claim 1, wherein the sinter blend composition additionally comprises one or more additives selected from the group consisting of limestone, quick lime, olivine and silica sand.

9. The sinter blend composition of claim 8, wherein the sinter blend composition contains additives comprising, by weight, between 10.00% and 14.00% limestone, between 0.50% and 4.00% quick lime, between 0.50% and 5.00% olivine and between 0.50% and 3.50% silica sand.

10. The sinter blend composition of claim 2, wherein the sinter blend composition comprises, by weight:

approximately 33.87% high metallic content blend, approximately 25.09% oxide blend, approximately 4.84% sludge blend, approximately 1.80% dust blend, and approximately 16.40% DF blend;

additives, comprising approximately 12.15% limestone, approximately 1.98% quick lime, approximately 2.56% olivine and approximately 1.31% silica sand; and having an ISO tumble strength of between 79.2 and 83.9.

11. The sinter blend composition of claim 1, wherein the sinter blend composition additionally comprises one or more fluxes in an amount necessary to meet target basicity, silica, and magnesium oxide levels in sinter.

12. The sinter blend composition of claim 11, wherein the one or more fluxes are selected from the group consisting of limestone, dolo-stone, quick lime, hydrated lime, milk of lime, magnesite, olivine, serpentine, and silica sand.

13. The sinter blend composition of claim 2, wherein the high metallic content blend and DF blend comprise metallic iron, iron oxide, silicon dioxide ($SiO_2$), aluminum oxide ($Al_2O_3$), calcium oxide (CaO), magnesium oxide (MgO) and carbon (C).

14. The sinter blend composition of claim 13, wherein:

the high metallic content blend comprises, by weight, between 1.0% and 3% $SiO_2$, between 0.05% and 2.0% $Al_2O_3$, between 0.50% and 2.50% CaO, between 0.05% and 1.50% MgO, between 0.20% and 2.20% C; and the remainder being impurities.

15. The sinter blend composition of claim 2, wherein:

the sinter blend composition additionally comprises water, with return fines of 30% of wet mix that is fired to produce sinter; and the sinter blend composition comprises, by weight:

33.87% high metallic content blend, 25.09% oxide blend, 4.84% sludge blend, 1.8% dust blend, 16.4% DF blend, with a calculated metallic blend percentage of 21.00%; and additives in the amount 12.15% limestone, 1.98% quick lime, 2.56% olivine and 1.31% silica sand.

16. The sinter blend composition of claim 1 comprising, by weight:

a total dry mix of metallics of 21.69%;

a total dry mix flux of 18.00% with a mix moisture of 7.6%, a return fines weight percentage of 30%; and an ISO tumble strength of 81.30.

17. The sinter blend composition of claim 2, wherein:

the component size distribution of the DF blend passes a sieve mesh size of less than 0.147 mm.

18. The sinter blend composition of claim 1, wherein the sinter blend composition comprises, by weight, between 17.0% and 23.0% DF blend.

* * * * *